US008386330B1

(12) United States Patent
Kulavade et al.

(10) Patent No.: US 8,386,330 B1
(45) Date of Patent: Feb. 26, 2013

(54) TOOL FOR AUCTION GROUPING BY PREFERENCE AND EXTENSIONS OF TIME

(75) Inventors: Vijay Kulavade, Clark, NJ (US); Dhananjay Nagalkar, Bridgewater, NJ (US); Subhash Makhija, Westfield, NJ (US); Anand Rau, Edison, NJ (US)

(73) Assignee: Global eProcure, Clark, NJ (US)

( * ) Notice: Subject to any disclaimer, the term of this patent is extended or adjusted under 35 U.S.C. 154(b) by 370 days.

(21) Appl. No.: 12/460,415

(22) Filed: Jul. 17, 2009

(51) Int. Cl.
*G06Q 30/00* (2006.01)

(52) U.S. Cl. ..... 705/26.3; 705/26.1

(58) Field of Classification Search ..... 705/26–27
See application file for complete search history.

(56) References Cited

U.S. PATENT DOCUMENTS

| | | | | |
|---|---|---|---|---|
| 6,216,114 | B1 | 4/2001 | Alaia et al. | |
| 6,223,167 | B1 | 4/2001 | Alaia et al. | |
| 6,230,146 | B1 | 5/2001 | Alaia et al. | |
| 6,408,283 | B1 | 6/2002 | Alaia et al. | |
| 6,499,018 | B1 | 12/2002 | Alaia et al. | |
| 6,976,005 | B1 | 12/2005 | Bansal et al. | |
| 7,146,331 | B1 * | 12/2006 | Young | 705/26.3 |
| 7,346,574 | B2 | 3/2008 | Smith et al. | |
| 7,395,238 | B2 | 7/2008 | Alaia et al. | |
| 7,461,022 | B1 | 12/2008 | Churchill et al. | |
| 7,958,009 | B1 * | 6/2011 | Kumar | 705/30 |
| 2001/0032175 | A1 | 10/2001 | Holden et al. | |
| 2003/0187774 | A1 * | 10/2003 | Kummamuru et al. | 705/37 |
| 2003/0233315 | A1 | 12/2003 | Byde et al. | |
| 2004/0039680 | A1 | 2/2004 | Horch et al. | |
| 2005/0119963 | A1 | 6/2005 | Ko | |
| 2008/0004975 | A1 | 1/2008 | Scargill et al. | |
| 2008/0046329 | A1 | 2/2008 | Logan | |
| 2008/0065527 | A1 | 3/2008 | Chieu et al. | |
| 2008/0133377 | A1 * | 6/2008 | Alaia et al. | 705/26 |
| 2008/0154763 | A1 | 6/2008 | Alaia et al. | |
| 2008/0235113 | A1 | 9/2008 | Rabenold et al. | |
| 2008/0262943 | A1 | 10/2008 | Mullendore | |
| 2008/0313089 | A1 | 12/2008 | Du Preez | |

FOREIGN PATENT DOCUMENTS

| | | |
|---|---|---|
| WO | 2007030873 | 3/2007 |

OTHER PUBLICATIONS

Jansen, B., "Paid Search as an Information Seeking Paradigm" (Bulletin of the American Society for Information Science & Technology, Dec. 2005/Jan. 2006, vol. 32, No. 2, pp. 7-8).*

* cited by examiner

*Primary Examiner* — Jeffrey A Smith
*Assistant Examiner* — Ethan D Civan
(74) *Attorney, Agent, or Firm* — Camille L. Urban; David M. Breiner

(57) ABSTRACT

A tool used for managing multiple auctions is presented. The tool includes instructions providing the capability of creating subgroups of auctions based on criteria used to sort data pertaining either to the subject matter of the auction or to its participants. Further, the tool manages within-group closing times by extending closing times of all auctions in the group. A comparison of a recent bid to extension criteria may extend the closing time of an auction by an extension period; if the number of times this auction is extended meets a trigger number, then all closing times of all auctions in the group are extended by a specified time related to the trigger number and the extension period.

19 Claims, 6 Drawing Sheets

*Auto-grouping*

*Activity-based Sorting*

TOOL FOR AUCTION GROUPING BY PREFERENCE AND EXTENSIONS OF TIME

FIELD OF THE INVENTION

The present invention relates in general to on-line auctions and, more particularly, to tools employed by auction managers or coordinators managing multiple auctions.

BACKGROUND OF THE INVENTION

In the last ten years, on-line auction capabilities, features, and functions have evolved at lightning speed. Nearly as popular as forward auctions (auctions where bidders enter higher bids in order to win the item or service sold by the seller), reverse auctions (auction where bidders enter lower bids to entice a buyer to select the item or service sold by the bidder) have become the procurement tool of choice in many industries.

It is typical that an on-line auction be conducted electronically. Each participant in an auction does so through a remote site. The participant typically sends information from its remote site via a communications network (e.g. a network services provider) to an auction coordinator at its own remote site; the coordinator sends information to the participant in the same manner. The auction is actually managed by a software application which usually includes a client component operating at the remote site of the participant and a server component which typically operates at the coordinator's remote site. The client component communicates the bids entered by the participant to the server component. The server component communicates updates about the auction to the client component. Most often the client component includes software used to connect to the server component, usually via telephone lines or the interne.

The popularity of the electronic auction format is evident by the dozens of auctions occurring at any one time. These auctions are forward or reverse or conducted with different auction rules. The auctions move nearly any kind of service and any kind of item. They are conducted by and for entities all over the world and may include participants scattered across the globe. The length of any given auction may be hours, days, or longer. The level of participation and the speed with which bids are placed vary with a number of factors. Because of the broad acceptance and the success of using this method to move services or products, the sheer volume of possible participants has motivated the development and implementation of tools to increase the efficiency of the auctions.

The entity wishing to purchase services or items from suppliers or an entity wishing to sell a service or item may employ a service to manage auctions on its behalf or may employ special tools to assist with the management of its auctions. The service may employ tools that provide means to separate and select possible participants. For example, the auction holder may be allowed to specifically designate certain suppliers it wishes the service to invite to the auction or to provide certain requirements for eligibility of suppliers which the service applies to determine the group of invitees. Often, such services use tools that store information about past participants, both buyers and sellers, making the group of invitees simple to select based on characteristics such as the physical location of the past participants, its inventory or offerings, or its credit standing. Further, stored information can be used to assess the likely participation of a particular supplier in a specific auction and may even be applied to set a prebid ceiling or floor for that supplier all based on its prior bidding behavior. It is not unusual to allow the entity wishing to purchase to set reserve prices, or to enter particular bid ceilings for a specific supplier with whom it has done business in the past or is the present encumbant of a supply contract with the auction holder.

With all of the auctions being conducted, it is typical that many occur at the same time or overlap to a certain extent. If a participant wishes to participate in several simultaneous auctions, and more than one is scheduled to close at a given time or one auction is extended so that its closing time coincides with that of another auction, then the participant is faced with the challenge of how to manage both auctions. It is often the case that the latter part of an auction enjoys the highest frequency of bidding activity which creates a difficult situation for the multi-auction participant. Further, bidding may be more complex than simply bidding a price and include factors such as distance, current inventory and ship date, and bidding on levels that include lots and/or line items. All of these factors together can create an auction wherein the auction holder does not receive the best bids because the participant is distracted and unable to participate effectively in simultaneous relevant auctions.

Those who manage multiple auctions have tried several approaches to solve the problem created by coincidental closing times. Often, auctions are scheduled to have staggered closing times. However, because of the propensity of some bidders to place their best bid just before the end of the auction thereby avoiding competitive bids, many auctions are set such that certain activity in the last minutes of the allotted time will act to extend the time to close the auction to allow other participants to adjust their bids if they so desire. When this happens, the extended closing time may coincide with or go beyond that of another auction the closing time of which had originally been staggered with that of the first auction, creating a situation where a participant cannot effectively participate in both auctions. To address this problem of coinciding closing times of multiple auctions, mechanisms to take into consideration the extension of the first lot and calculate specific extensions to be applied to each of several other auctions whose scheduled closing times would otherwise occur at the same time or before the first extended auction have been devised. However, these tools are fairly complex in the way they work and may result in so many changes a participant has difficulty keeping track or extends auctions participants had no interest in to begin with.

Further, several methods have been developed that allow a participant to group auctions together in order to help the participant manage bidding in simultaneous auctions. These methods include robot programs that allow the participant to prioritize the auctions, set a certain total amount of money for bid and set rules for placing bids and allocating and splitting bids in response to the progress of the market. However, to date there has not been a functional tool that facilitates grouping of auctions for the auction manager. There is a need for a tool that allows auction managers to group auctions in a manner that facilitates full participation by the invited participants. A tool functioning in this manner should create an environment conducive to placing the best possible bids and maximizing the possible benefit to the auction holder.

It is one objective of the present invention to provide a simple mechanism for triggering and setting extensions of time for related auctions based on activity in the leading auction.

It is another objective of the present invention to provide a tool for grouping auctions to create a group of auctions described by a specified set of characteristics.

It is a final objective of the present invention to provide a means for grouping auctions in a manner that allows for participation by desirable participants and managing the closing times of such auctions to facilitate the full participation of the desired participants.

SUMMARY OF THE INVENTION

The auction management tool of the present invention addresses the problems identified in prior systems by providing a tool that allows the user to create a group of auctions based on particular characteristics of the auctioned services or products and or certain dimensions pertaining to the participants in the auctions. Further, the auction management tool facilitates participation of the participants by extending the closing times of certain auctions relative to bidding activity in other auctions within the group. A group of auctions may be selected based on characteristics of the auctioned services or product and/or the participants in those auctions but the overall objective is to group auctions in such a way that maximizes the opportunity for the auction holder to receive the best bid.

Grouping of auctions occurs by first identifying the invitees or voluntary participants that have accepted an invitation to a variety of auctions under common management. Next, the auctions are each analyzed along several dimensions, for example, length of time needed for the auction, date range for the auction, participant's past participation specifics, the identification of the services/products being offered and any specific related characteristics of the services/products, location of the participants, and priorities or preferences set by the auction holder related to the service/product and/or the participants. Upon completion of the analysis, the tool will suggest assignments of certain auctions to a common group based on the analyses.

If more than one group has been set, and the groups exhibit certain between-group commonalities for example commonalities that indicate an overlap of interested participants, then the groups are scheduled by the tool so that no overlap of time between groups is likely. Multiple groups that do not share a critical between-group commonality can be scheduled simultaneously.

Next, the tool presents the auction manager with selections pertaining to extensions of time for auctions within a group. Because these auctions have certain commonalities, it is important that a participant be able to fully participate in all auctions in the group. Therefore, the closing times, including any extensions of time, must be carefully, yet simply, managed.

The present invention allows the auction holder to select a set time period by which a lead auction in a group of auctions may be extended based on certain activity in the last moments of the lead auction. The auction holder also selects the number of set time periods that, if occur in the lead auction, will trigger extensions of times to close in the remaining auctions in the group. Once the trigger number of time periods is reached, the closing times of all the remaining auctions in the group are extended by a time equal to the trigger number of time periods. Should the auction holder so desire, if the trigger number of time periods is reached in the lead auction again, then the closing periods of the remaining auctions may be again extended. Upon close of the lead auction, the auction within the group with the next scheduled closing time becomes the lead auction and its extensions effect the remaining auctions in the same general manner.

The advantage of this extension system is that several extensions may occur in the lead auction without effecting closing times of any other auctions in the group thereby reducing the number of adjustments overall. Further, because the trigger number of the time periods is set by the auction holder, no calculations of time between lead auction closing time and the closing times of other auctions needs to be performed; either all remaining auctions are effected and effected by the same pre-set length of extension or none are effected.

The present invention is embodied in a computer readable medium comprising instructions executable by a processor whereby the processor causes a computer to perform certain tasks. The computer readable medium may comprise a client component, a server component, or both. A first client component is typically run on an auction participant's computer and allows the auction participant to enter and send data and bids through a network service provider to a server component. A second client component is typically run on an auction holder's computer and allows the auction holder to enter and send data through the network services provider to the server component. The server component sends information such as auction updates to the auction participant and to the auction holder through the network service provider.

Other objects, features, and advantages of the present invention will be readily appreciated from the following description. The description makes reference to the accompanying drawings, which are provided for illustration of the preferred embodiment.

However, such embodiment does not represent the full scope of the invention. The subject matter which the inventor does regard as his invention is particularly pointed out and distinctly claimed in the claims at the conclusion of this specification.

DETAILED DESCRIPTION

The present invention is comprised of three major aspects: 1) storing and sorting data about services/products to be auctioned and about the participants in auctions; 2) assigning specific priorities to certain data and applying rules to form a group or groups of auctions optimized for participation; and 3) administering a group of auctions by employing a specific pattern governing relational extensions of overtime again with the objective of optimizing participation.

The computer readable medium of the present invention comprises instructions for execution by a processor. For each of a plurality of auctions, the instructions cause the processor to store data entered about the service/products which are the subject of each auction. This data fits into predetermined criteria describing categories such as the service/products, shipping modes, assembly, etc. Further, the instructions cause the processor to store data about each participant which was entered when the participant previously participated in an auction accessible by the processor or gathered as a result of an invitation to participate in an auction and to store data entered about a participant from other sources. Data about participants fits into predetermined criteria describing categories such as address, name, credit/performance history, and past bidding history in other auctions.

Next, the instructions cause the processor to invite certain participants to certain auctions. The invitees are usually selected according to a relationship between the information stored about each participant and the data stored about the service/product to be auctioned although such a relationship is not essential. Once the willing participants are determined, the instructions cause the processor to create groups of auctions.

Figure 1:
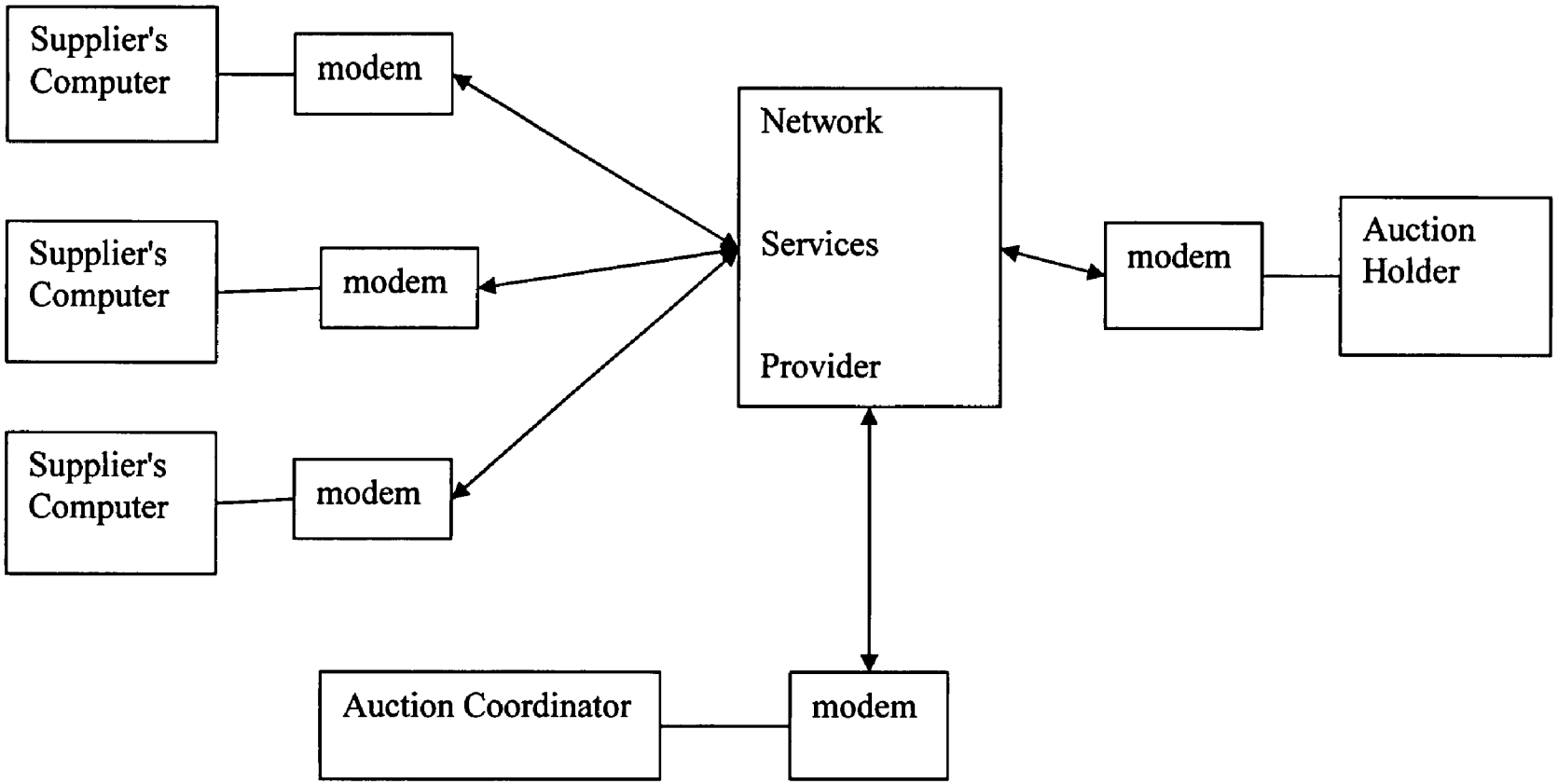
FIG. 1 is a schematic showing a communication method employed by the present invention.
Figure 2:
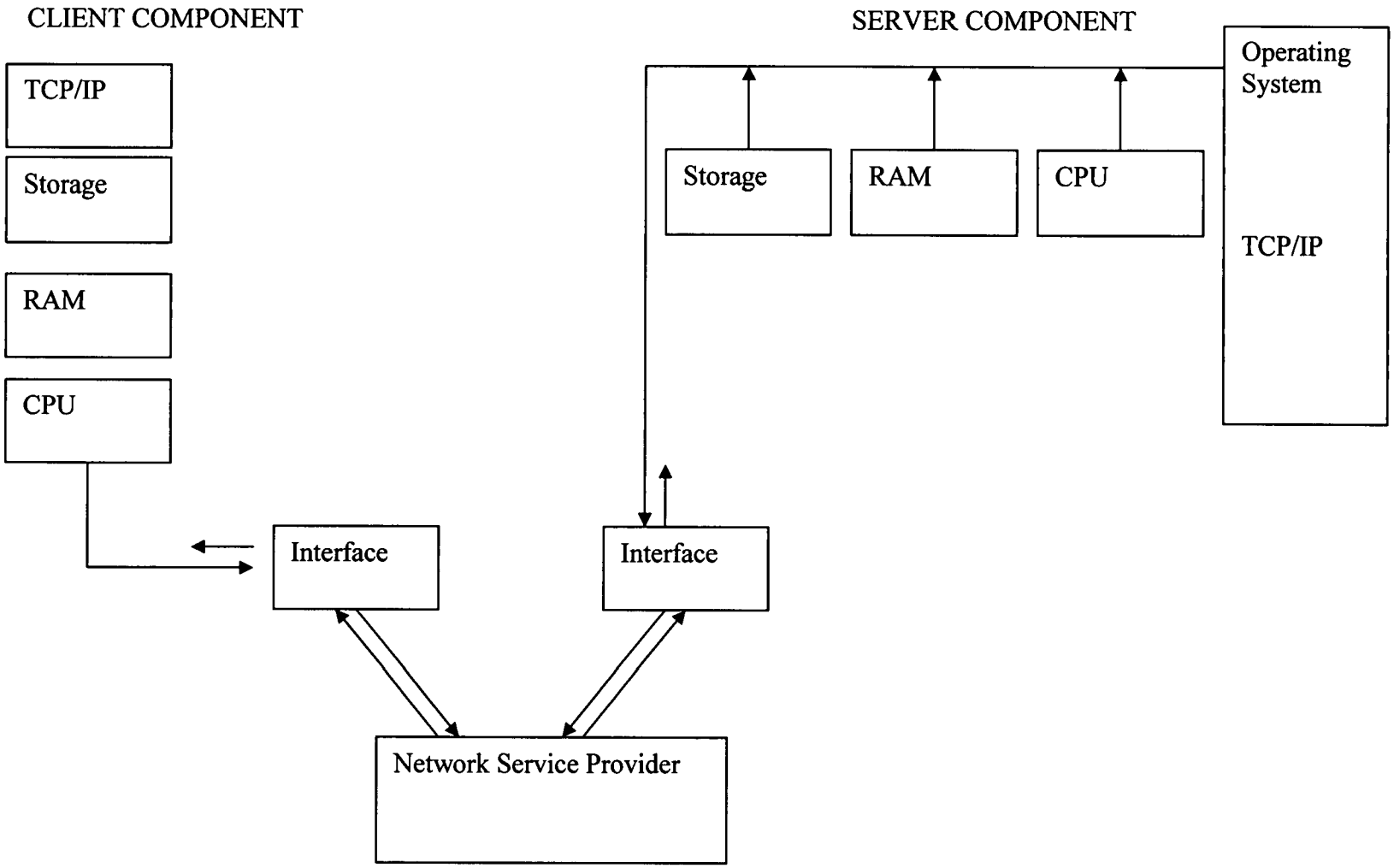
FIG. 2 is a schematic showing how a client component and a server component of the present invention may interact.
Figure 3:
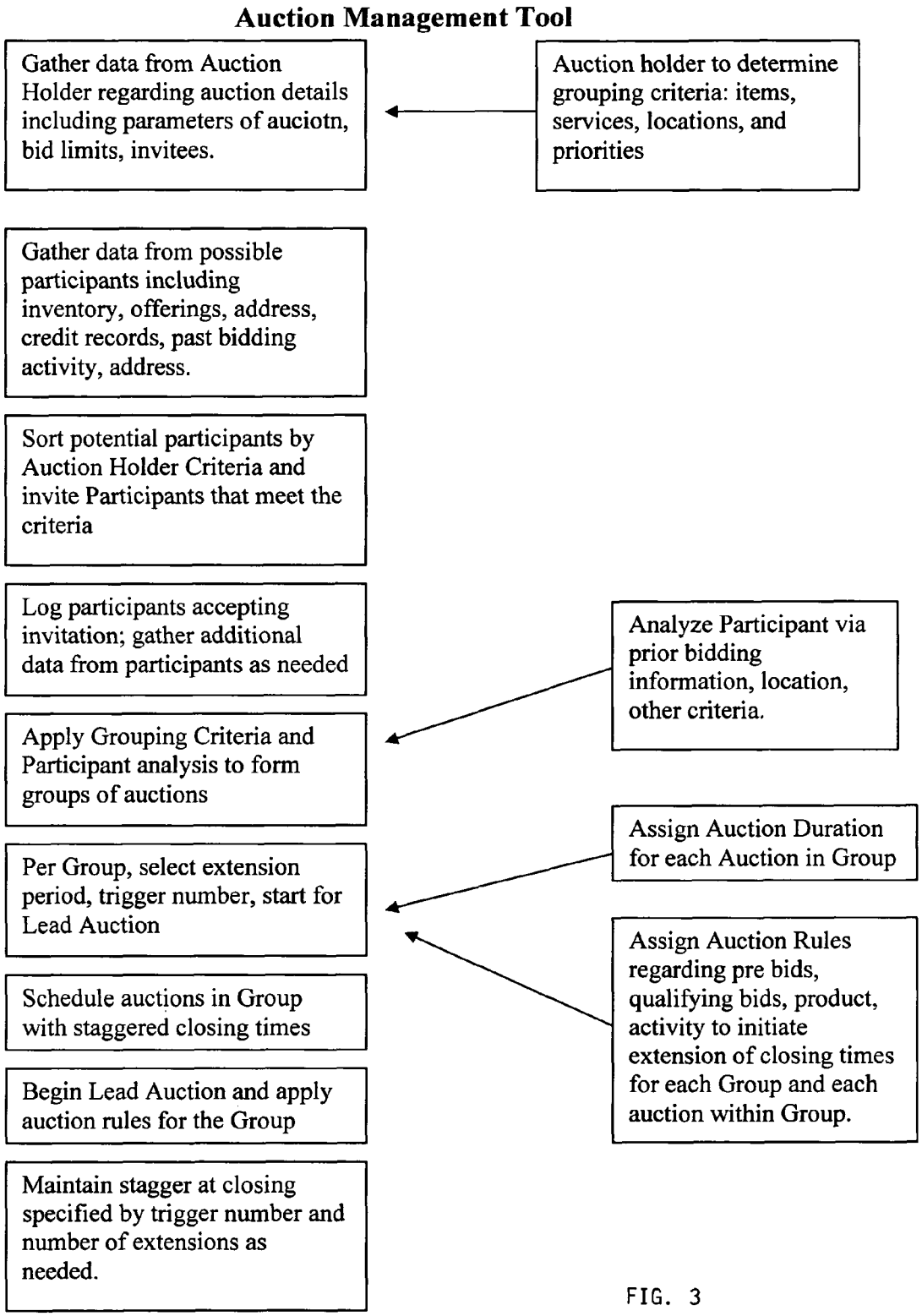
FIG. 3 is a schematic describing a process in which the present invention is employed.
Figure 4:
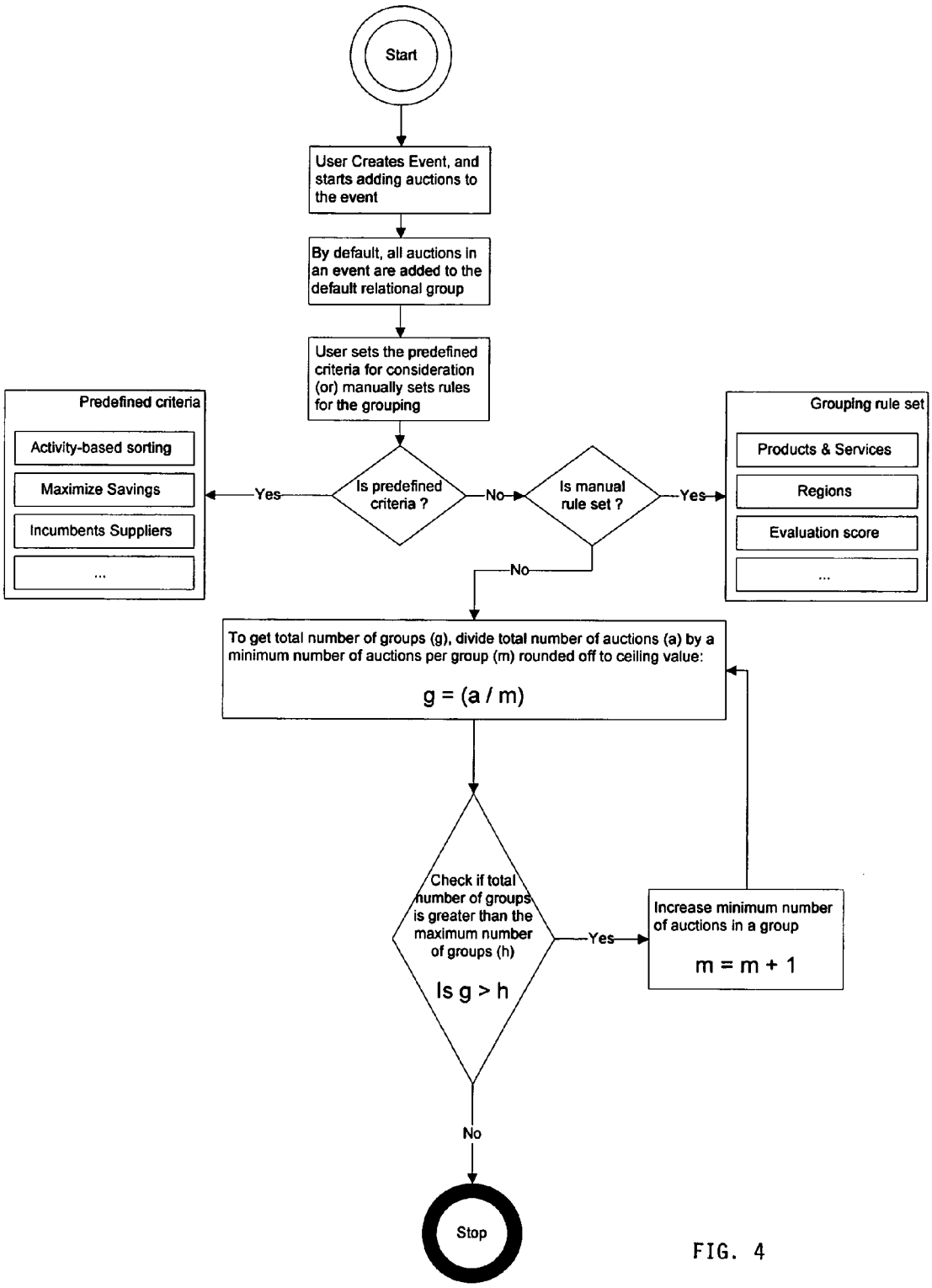
FIG. 4 is a flow chart illustrating the tasks implemented by the present invention through a processor and a computer for creating groups of auctions.
Figure 5:
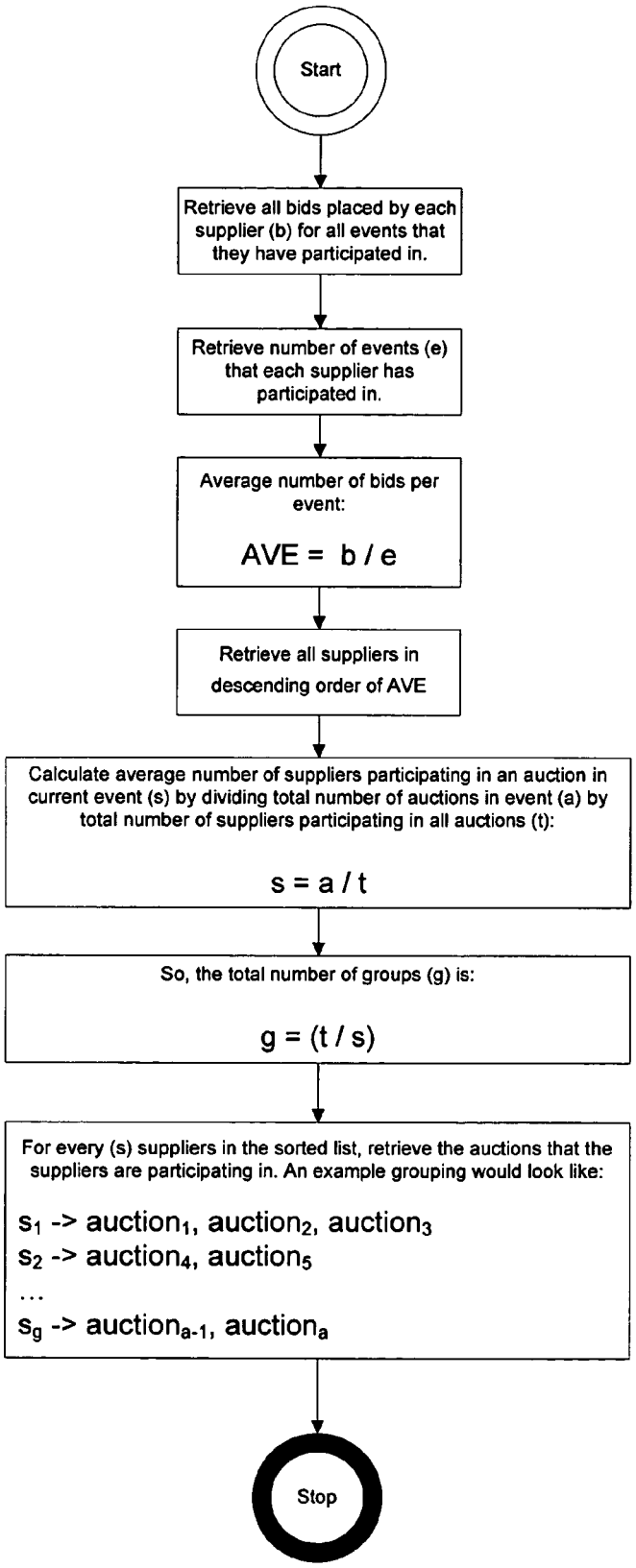
FIG. 5 is a flow chart describing the creation of groups based on past bidding activity of participants.

Groups are formed by sorting and filtering the stored information (see FIGS. 4 and 5). First, the instructions cause the processor to sort all information according to a predetermined priority level assigned to each criterion. Next, the instructions cause the processor to apply a rule processing the priorities of criteria pertaining to each auction and each participant to create groupings of auctions having, accounting for other possible relationships, the highest number of in-common supplier/participants.

EXAMPLE 1

Consider FIG. 4 where the predefined criteria selected for grouping is "activity-based sorting". Referring now to Table 1 below and FIG. 5, the instructions cause the processor to sort all the participants according to the level of bidding activity each has exhibited in past auctions, if any. The participants are then ranked from most active to least based on an average number of bids each has made in past auctions as shown in the second and third columns of Table 1. Next, the instructions cause the processor to determine the average number of suppliers per auction in the current set of auctions and to determine the maximum number of groups of auctions by dividing the total participants by the average number of participants per auction.

In this example, the average number of participants per auction is the total number of participants divided by number of auctions in the set or, 10/5=2. The instructions then divide the number of auctions by the average number of participants per auction to determine the number of groups of auctions or, 10/2=5. The ranked order listing of participants is then divided into groups of 2 according to past activity level to form 5 preliminary groups as shown in column 4 of Table 1.

| Auction Name | Supplier Name | Activity (Ave. number of bids per event - historical data) | Potential Grouping |
|---|---|---|---|
| Auction 5 | Supplier 8 | 3000 | $s_1$ |
| Auction 2 | Supplier 6 | 2500 | $s_1$ |
| Auction 3 | Supplier 5 | 2000 | $s_2$ |
| Auction 1 | Supplier 10 | 1600 | $s_2$ |
| Auction 2 | Supplier 2 | 1300 | $s_3$ |
| Auction 1 | Supplier 1 | 1200 | $s_3$ |
| Auction 4 | Supplier 4 | 500 | $s_4$ |
| Auction 1 | Supplier 7 | 0 | $s_4$ |
| Auction 4 | Supplier 9 | 0 | $s_5$ |
| Auction 2 | Supplier 3 | 0 | $s_5$ |

Finally, the instructions cause the processor to prefer the most active bidders and create final groups of auctions so each of the most active bidders is assigned to a single group that includes all the auctions for which that bidder is a participant or the minimum number of groups that covers. In this example, then, the first group of auctions is built to include auctions 2 and 5 so that each of the two most active participants is included in that group along with any of the other participants that have accepted invitations to those auctions. In this manner, the most active participants are preferred and have been assigned to a single group making the bidding deadlines much simpler for the participant to manage.

Figure 6:
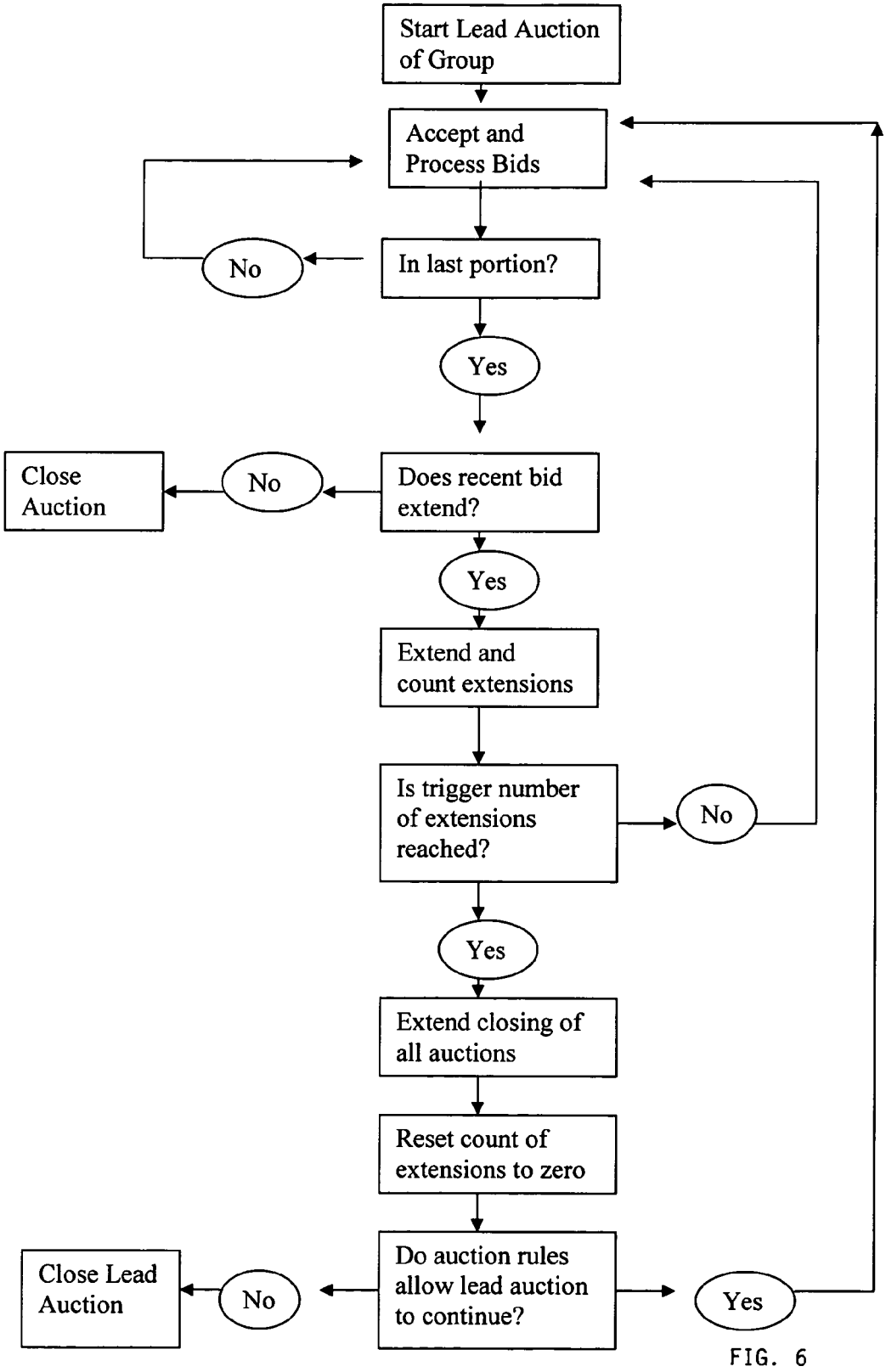
FIG. 6 is a flow chart describing the tasks whereby the present invention relationally extends closing times of auctions within a group of auctions.

Once the groups are formed and according to specifications provided by the auction holder, the processor assigns a duration for each auction within a group, extension criteria, an extension period, and a trigger number of extensions for the group of auctions. According to the instructions of the present invention and as illustrated in FIG. 6, the processor next schedules the auctions in each group according to certain objectives which may include minimizing the expected duration of the group, minimizing the overlap of auctions within the group, and ordering auctions within the group to begin according to a preset priority. In any event, the instructions cause the processor to stagger the scheduled closing times of the auctions in the group equal to or greater than the trigger number of extensions. Once scheduled, the processor opens the lead auction according to the schedule, keeps track of and processes bids entered by each participant and checks each bid against the extension criteria. When a bid meets the extension criteria, then the processor is instructed to extend the closing time of the lead auction by using the extension period. The processor also then determines if the trigger number of extension periods has been used. If the trigger number has not been used in the lead auction, the processor is instructed to continue checking each bid as it is entered against the extension criteria. If the trigger number has been used, then the process is instructed to reschedule the closing times of all of the remaining auctions in the group using a time period equal to or greater than the trigger number times the extension period.

EXAMPLE 2

Auctions A, B, C, and D have been assigned to a single group. The auction period has been chosen to extend if a new best bid is placed in the last minute of the auction period. The extension period has been chosen to be of two minutes' duration. The trigger number of extensions has been selected at five or n=5. The auctions have been assigned staggered closing times as follows:

| | |
|---|---|
| Auction A | 8:00 |
| Auction B | 8:10 |
| Auction C | 8:25 |
| Auction D | 8:40 |

Because it is currently in progress and is the first auction scheduled to close, Auction A is the "lead auction." Now, referring to FIG. 6, a new best bid is received in Auction A at 7:59:30 so that an extension period is assigned thereby changing the scheduled closing time to 8:02. A new best bid is received in Auction A at 8:01:22, a second extension period is assigned and changes the scheduled closing time to 8:04. A third extension period and a fourth extension period are likewise triggered to extend the closing time to 8:06 and 8:08, respectively. Finally, a fifth extension period is triggered thereby extending the closing time of Auction A to 8:10; Auction B to 8:20; Auction C to 8:35 and Auction D to 8:50.

Either Auction A will continue to receive best new bids and its time become extended accordingly, or it will close.

Once Auction A closes, then Auction B becomes lead auction. At that point, extensions of time triggered by new best bids placed in Auction B will extend Auction B's scheduled closing time. Should the trigger number of extensions occur, n=5 in this example, then all scheduled closing times of all remaining auctions will be extended by ten minutes once again.

The computer readable medium providing instructions to enable a processor to cause a computer to effectively group auctions according to criteria related both to the product/service of the auction and characteristics of participants in the auction is an improvement over other systems. Including simple instructions for avoiding closing time collisions within a group of auctions assists in maximizing participant participation.

Thus, the present invention has been described in an illustrative manner. It is to be understood that the terminology that has been used is intended to be in the nature of words of description rather than of limitation.

Many modifications and variations of the present invention are possible in light of the above teachings. For example, information collected from participants may vary from address to international participation to customer service. Information sorted and prioritized about services or items the subject of the auction might include color, general availability, required shipping date, level of assembly required. Auctions in a group may be scheduled so that some are staggered but those that are cognitively simple or less related than the others in the group may not be staggered. Therefore, within the scope of the appended claims, the present invention may be practiced otherwise than as specifically described.

The invention claimed is:

1. A non-transitory computer-readable medium for managing a plurality of auctions, the non-transitory computer-readable medium comprising instructions to cause a processor to:

store a set of data related to a plurality of auction participants, the set of data including information associated with the auction participants;

apply at least one rule to said set of data to rank the auction participants based on the information associated with the auction participants; and create multiple groups of auctions based on participant rankings.

2. The non-transitory computer-readable medium as claimed in claim 1, wherein said at least one rule causes said processor to evaluate said set of data and assign a rank order.

3. The non-transitory computer-readable medium as claimed in claim 1 wherein the information associated with the auction participants comprises values representing past bidding activity of each of the plurality of participants and the at least one rule comprises evaluating the past bidding activity values and assigning a rank order to the plurality of participants according to the past bidding activity values.

4. The non-transitory computer-readable medium as claimed in claim 1 wherein creating the multiple of auctions creates a group of auctions that has at least two of the highest ranked participants as auction participants.

5. The non-transitory computer-readable medium as claimed in claim 1, wherein the instructions further cause the processor to organize the auction participants in an ordered list based on the at least one rule applied to the set of data.

6. A non-transitory computer-readable medium for managing a plurality of auctions comprising instructions causing a processor to:

divide a plurality of auctions into at least one group of auctions, the at least one group of auctions comprising a subplurality of auctions having a lead auction and each said auction comprises a closing time;

establish a sequence for each said subplurality of auctions;

record and apply an extension period;

store a trigger number associated with each but the last sequential auction of said subplurality of auctions;

set a closing time for each said subplurality of auctions staggered and according to said sequence;

accept at least one bid for each auction in said subplurality; and apply at least one extension criteria.

7. The non-transitory computer-readable medium as claimed in claim 6, wherein the instructions further cause the processor to organize auction participants in an ordered list based on at least one rule applied to a set of data related to the auction participants.

8. The non-transitory computer-readable medium as claimed in claim 6 wherein each said closing time is initially staggered from the next by a time period at least equal to the trigger number of extension periods.

9. The non-transitory computer-readable medium as claimed in claim 8 wherein said instructions further comprise causing the processor to compare each said bid in said lead auction to said extension criteria; to store the number of extension periods granted in said lead auction; to extend the closing time of the lead auction.

10. The non-transitory computer-readable medium as claimed in claim 9 wherein said instructions further comprise causing the processor to determine whether the number of extension periods granted at least equals the trigger number.

11. The non-transitory computer-readable medium as in claim 10 wherein if the number of extensions granted at least equals the trigger number said processor causes said closing time of each of said subplurality of auctions to extend by a time period at least equal to said extension period multiplied by said trigger number.

12. A non-transitory computer-readable medium for managing a plurality of auctions comprising instructions causing a processor to:

store a set of data related to a plurality of auction participants, the set of data including information associated with the auction participants, apply at least one rule to said set of data to rank the auction participants based on the information associated with the auction participants, and create multiple groups of auctions based on participant rankings, said multiple groups of auctions comprising subpluralities of auctions having a lead auction and each said auction comprising a closing time;

establish a sequence for each said subplurality of auctions, record and apply an extension period, store a trigger number associated with each but the last sequential auction of said subplurality of auctions, set a closing time for each said subplurality of auctions staggered and according to said sequence, accept at least one bid for each auction in said subplurality, and apply at least one extension criteria.

13. The non-transitory computer-readable medium as claimed in claim 12, wherein the instructions further cause the processor to organize the auction participants in an ordered list based on the at least one rule applied to the set of data.

14. The non-transitory computer-readable medium as claimed in claim 12 wherein creating at least one group of auctions comprises causing the processor to create the minimum number of groups of auctions in which the participant rank ordered first participates.

15. The non-transitory computer-readable medium as claimed in claim 14 wherein said set of data comprises values representing past bidding activity of each of said plurality of participants and said at least one rule comprises evaluating said past bidding activity values and assigning a rank order to said plurality of participants according to said values.

16. The non-transitory computer-readable medium as claimed in claim 12 wherein each said closing time is initially staggered from the next by a time period at least equal to the trigger number of extension periods.

17. The non-transitory computer-readable medium as claimed in claim 12 wherein if the number of extensions granted at least equals the trigger number said processor causes said closing time of each of said subplurality of auctions to extend by a time period at least equal to said extension period multiplied by said trigger number.

18. The non-transitory computer-readable medium as claimed in claim 12 wherein said set of data comprises values representing past bidding activity of each of said plurality of participants and said at least one rule comprises evaluating said past bidding activity values and assigning a rank order to said plurality of participant according to said past bidding activity values; creating at least one group of auctions comprises causing the processor to create the minimum number of groups of auctions in which the participant rank ordered first must participate; and, each said closing time is staggered from the next by a time period at least equal to the trigger number of extension periods.

19. The non-transitory computer-readable medium as claimed in claim 12 wherein said set of data comprises values representing past bidding activity of each of said plurality of participants and said at least one rule comprises evaluating said past bidding activity values and assigning a rank order to said plurality of participant according to said past bidding activity values; each said closing time is staggered from the next by a time period at least equal to the trigger number of extension periods; said instructions further comprise causing the processor to compare each said bid in said lead auction to said extension criteria, to store the number of extension periods granted in said lead auction, determine whether the number of extension periods granted at least equals the trigger number and if the number of extensions granted at least equals the trigger number said processor causes said closing time of each of said subplurality of auctions to extend by a time period at least equal to said extension period multiplied by said trigger number.

* * * * *